US005411329A

United States Patent [19]

Perry

[11] Patent Number: 5,411,329

[45] Date of Patent: May 2, 1995

[54] PORTABLE LARGE VOLUME CEMENT MIXER FOR BATCH OPERATIONS

[76] Inventor: L. F. Perry, Rte. 3, Box 28, Olney, Tex. 76374

[21] Appl. No.: 82,725

[22] Filed: Jun. 28, 1993

[51] Int. Cl.[6] ..... B28C 5/20

[52] U.S. Cl. ..... 366/26; 366/45; 366/61; 366/62; 366/185; 414/332; 414/468

[58] Field of Search ..... 366/16, 18, 26–28, 366/41, 45, 46, 53, 54–56, 60–63, 185, 187, 219, 220, 233, 606; 414/21, 332, 468, 477, 501, 919

[56] References Cited

U.S. PATENT DOCUMENTS

| | | | |
|---|---|---|---|
| 863,451 | 8/1907 | Davis | 366/26 |
| 1,588,994 | 6/1926 | Rasmussen | 414/21 |
| 2,133,170 | 10/1938 | Johnson | 366/45 |
| 2,740,539 | 4/1956 | Oaks, Jr. | 414/21 |
| 3,148,867 | 9/1964 | August et al. | 366/26 |
| 3,244,411 | 4/1966 | Kuhner | 366/18 |
| 3,421,744 | 1/1969 | O'Connell | 366/45 |
| 4,339,204 | 7/1982 | Placzek | 366/18 |
| 4,525,070 | 6/1985 | Gressette, Jr. | 366/26 X |
| 4,775,275 | 10/1988 | Perry | 414/21 |
| 4,951,261 | 8/1990 | Strehlow | 366/185 X |

FOREIGN PATENT DOCUMENTS

| | | | |
|---|---|---|---|
| 1459220 | 1/1969 | Germany | 366/26 |
| 3604331 | 8/1987 | Germany | 366/26 |

*Primary Examiner*—David A. Scherbel
*Assistant Examiner*—Charles Cooley
*Attorney, Agent, or Firm*—Dougherty, Hessin, Beavers & Gilbert

[57] ABSTRACT

A large volume cement mixer that is readily mobile and can be set up for use with a concrete batch plant at a given location. The cement mixer is carried on an elongated frame having wheels on one end and a gooseneck connection on the front end for towing purposes. A longitudinally movable carriage is carried on top of the elongated frame and the carriage is adapted to carry a large cement mixer mounted thereon. In operation, the elongate frame is braced in approximately 45° angle attitude as the carriage supports the cement mixer in generally horizontal, rotatable fixture. Hydraulic devices are provided for rotating the cement mixer during the mixing mode of operation and, after completion, the carriage structure is hydraulically controlled to move upward along the elongate frame to a dump position whereupon the cement mixer is rotated forward and the mixed concrete is allowed to fall to a discharge position.

16 Claims, 5 Drawing Sheets

PORTABLE LARGE VOLUME CEMENT MIXER FOR BATCH OPERATIONS

BACKGROUND OF THE INVENTION

1. Field of the Invention

The invention relates generally to mobile-type batch plants and, more particularly, but not by way of limitation, it relates to an improved portable cement mixer that can be set up to function with an existing type of mobile batch plant to enable large volume concrete mixing and distribution.

2. Description of the Prior Art

The prior art includes various types of batching plants, both permanent and mobile installations, and these batching plants are intended to function with the conventional cement mixing truck, i.e., the batching plants serving to weigh and deliver the ingredient components while the mixing trucks function to mix and deliver the concrete to a construction site. The mobile batch plant that is identified as prior art herein is the subject matter of the invention disclosed in U.S. Pat. No. 4,775,275, issued on Oct. 4, 1988 and entitled "MOBILE BATCH PLANTS". The inventor is not aware of any prior type of mobile mixing plant suitable to carry out the combinative function as set forth in the present specification.

SUMMARY OF THE INVENTION

The present invention relates to high volume cement mixers of the portable type for use in combination with selected existing types of concrete batching plants that also may be of the portable type. In particular, the present invention could be used in combination with a portable concrete batching plant such as that of U.S. Pat. No. 4,775,275 which functions to meter out and deliver each of the dry component materials of concrete to a discharge point in the structure. The present invention is a wheeled and towable structure which can be set up adjacent the batching plant to place a high volume concrete mixer at the materials discharge point so that the mixer can receive component materials, rotationally mix the concrete, and thereafter dump the concrete into selected conveyors or trucks for delivery to a construction site.

The portable mixer consists of an elongated frame with support wheels at the rear end and a gooseneck tow configuration at the front end. The elongated frame carries a longitudinally movable carriage frame in wheeled support thereon and the carriage frame supports a rotatable concrete mixer. When the portable mixer is delivered to a work site, the elongated frame may be tilted upward at an angle of about 45° and supported by means of earth stanchions, this attitude placing the concrete mixer entry opening beneath the discharge point of the batching plant. The batching plant can then charge the concrete mixer whereupon hydraulically driven rotating mechanism mixes the concrete. When the mixer is completely charged, as the concrete is being mixed, hydraulic equipment is energized to draw the carriage assembly upward along the elongated frame to an elevated discharge point whereupon hydraulic mechanism then functions to rotate the cement mixer forward and down to a dump position which will coincide with a loading point for subsequent concrete conveyor apparatus. The apparatus folds into a relatively compact unit whereupon the wheeled elongate frame can be towed along all lawful rights-of-way.

Therefore, it is an object of the present invention to provide a portable concrete mixer having large volume capability.

It is also an object of the present invention to provide such a portable assembly that is easily altered or broken down from set up position and vice versa during location movement operations.

It is yet further an object of the invention to provide a high volume portable cement mixer for co-action with existing concrete batching plants.

Finally, it is an object of the present invention to provide a portable concrete mixing assembly that can be easily set up for operation and secured by installation and positioning of relatively few stabilizing elements.

Other objects and advantages of the invention will be evident from the following detailed description when read in conjunction with the accompanying drawings which illustrate the invention.

BRIEF DESCRIPTION OF THE DRAWINGS

FIG. 6 is a side view in elevation of the portable concrete mixer set up for operation in conjunction with the portable concrete batch plant as shown in FIGS. 1 and 2.

DETAILED DESCRIPTION OF THE INVENTION

Figures 1, 2:
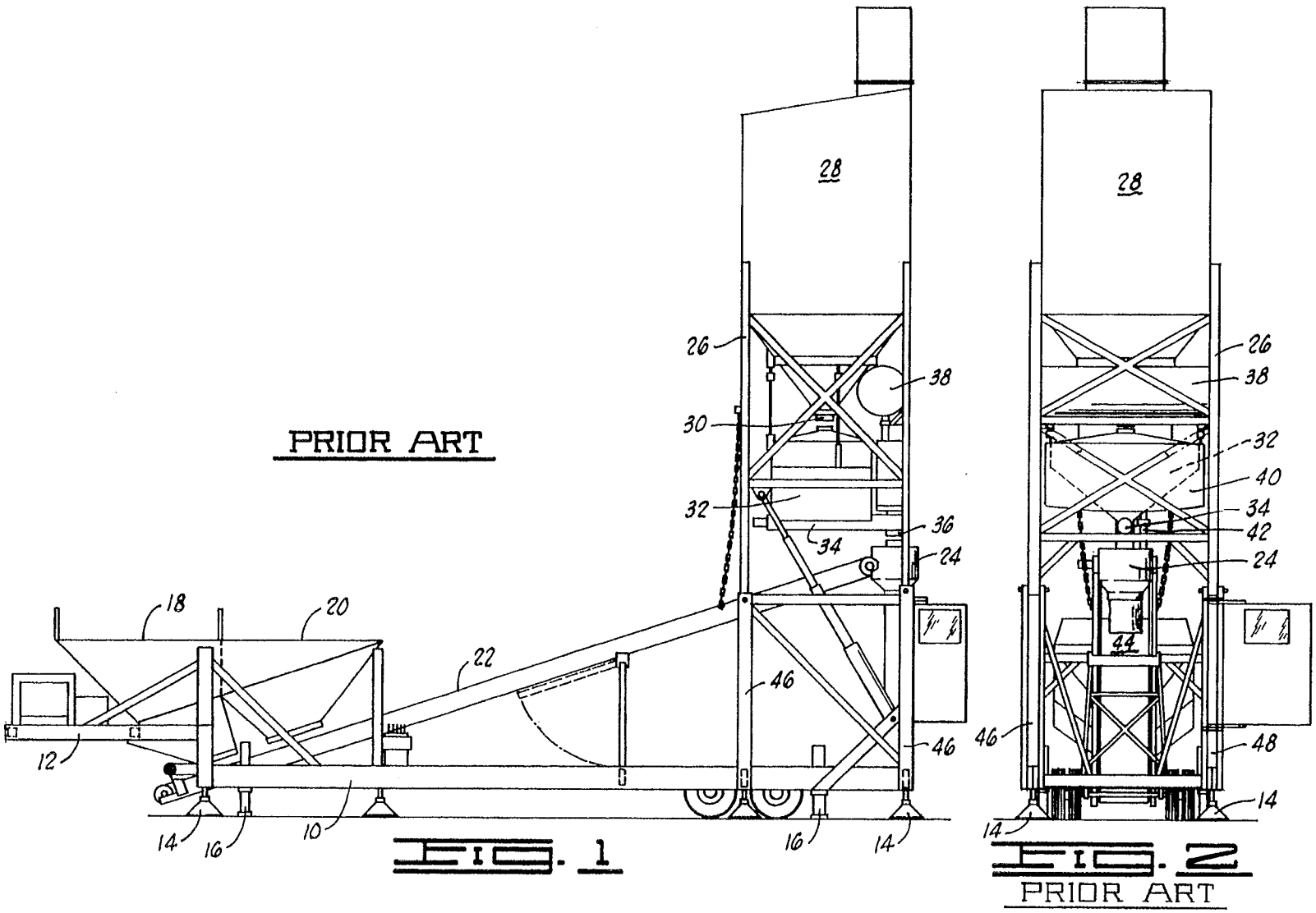
FIG. 2 PRIOR ART
FIG. 1 is a view in side elevation of a prior art form of portable concrete batching plant.
FIG. 2 is an end view in elevation of the batching plant of FIG. 1.

Referring to FIGS. 1 and 2, the prior art is exemplified for mobile batch plants by a showing of the inventor's prior U.S. Pat. No. 4,775,275. The entire concrete batching plant is foldably mounted on a mobile frame 10 having a gooseneck tongue formation 12 for affixture to a towing vehicle. FIGS. 1 and 2 show the batching plant in its folded-out or ready position with all stabilizing jacks 14 and hydraulic jacks 16 placed in engagement. The separate bins 18 and 20 for sand and aggregate material are aligned to drop the metered material downward on to a conveyor 22 which carries materials upward for deposit within a funnel type collector 24.

A tower 26 is also raised and secured in upright position to support a concrete or dried cement bin 28 which releases cement down through a gate 30 into a concrete weigh bin 32 in place for screw feeder 34 to deliver the dry material for release at a gate 36 into the funnel collector 24. Water under continual feed is present in a surge tank 38 and can be flowed into a water weigh tank 40 for subsequent controlled release via conduit 42 into the funnel collector 24. Thus, input materials are delivered via aggregate conveyor 22, dry cement gate 36, and water conduit 42 through the funnel collector 24 to a collector point 44 immediately therebelow.

The collector point 44 would be the point immediately below the funnel collector 24 wherein a cement mixer would receive the materials charge for subsequent mixing of finished concrete as will be further discussed below. The tower 26 is supported on each side by means of vertical post pairs 46 and 48 as they define a space for access where a conventional cement mixer truck can back in to receive charge of mixed concrete at the distribution point 44.

Figure 4:
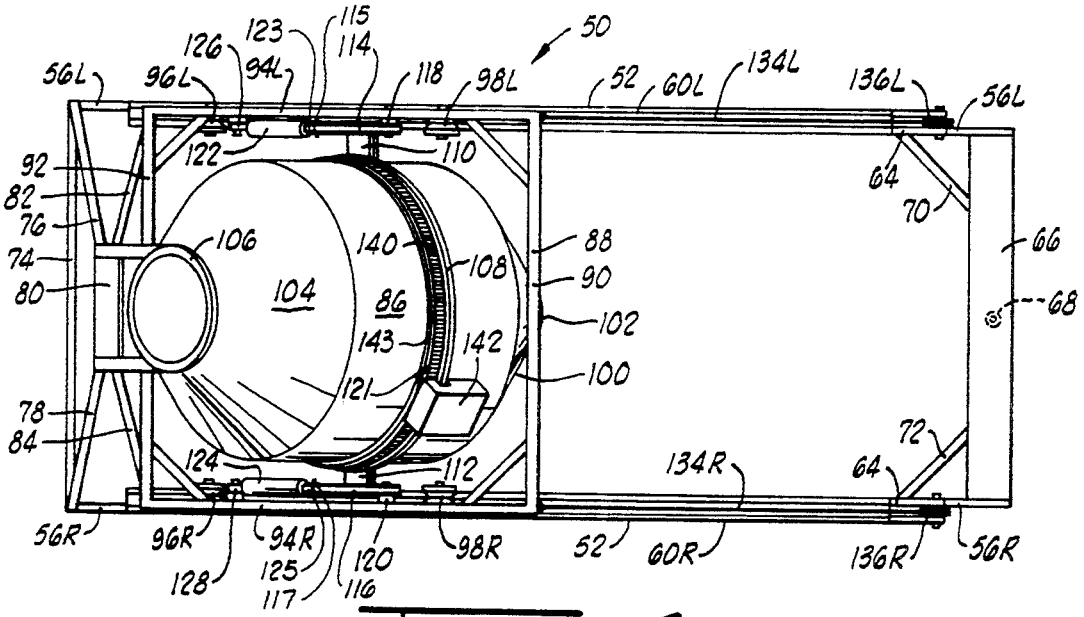
FIG. 4 is a top plan view of the portable concrete mixer of FIG. 3.
Figure 3:
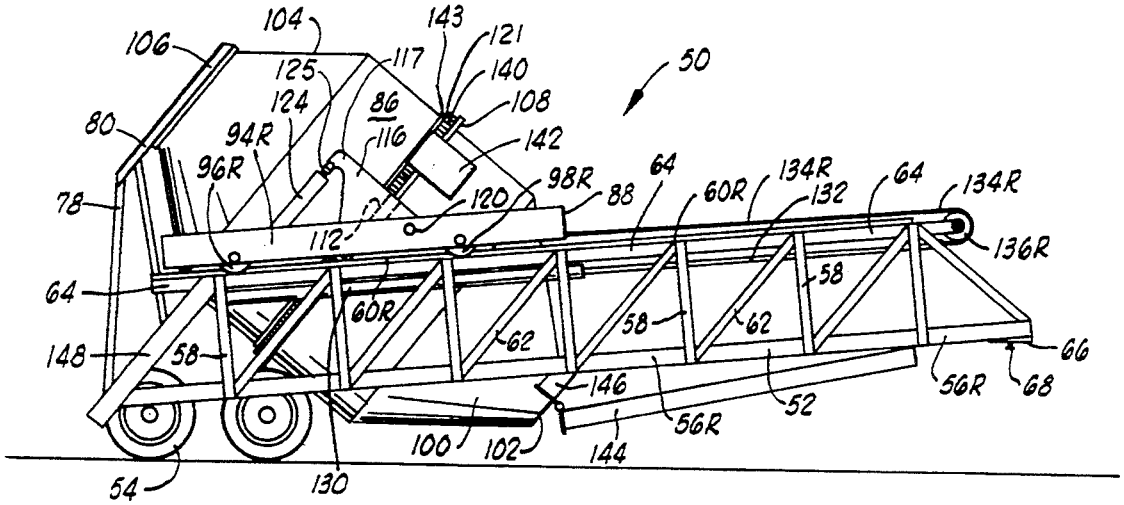
FIG. 3 is a side view of a portable concrete mixer station constructed in accordance with the present invention.

In the present invention, the combination consists of the mobile batch plant in combination with the large volume portable mixer as shown in FIGS. 3 through 7, as will now be further described. Referring to FIGS. 3 and 4, the portable cement mixer 50 consists of an elongated frame 52 adapted for forward towing as supported by rear end tandem wheels 54. It is understood that both sides are identically constructed. Thus, the elongated frame 52 has a primary lower frame member 56L and R extending the length of the rig on each side with a plurality of upright post members 58 suitably secured as by welding to support respective upper guide rail members 60L and R which extend along the length of the unit from rear wheels 54 to adjacent the forward section. Each side frame also includes a plurality of diagonal braces 62 welded in support of upright frames, and an elongated frame plate 64 is welded adjacent the inner edge of top guide rails 60L and R to provide longitudinal strengthening along the length of the opposite side frames.

The lower frame members 56L and R of opposite side frames are joined in front by a transverse bar member 66 which carries a gooseneck fixture 68 centrally therebeneath. Opposite corner braces 70 and 72 are secured diagonally between respective lower frame members 56L and R and the transverse bar 66 to firm up the forward structure. At the rear, the opposite frame members 56L and R are secured to a transverse bar 74 (see FIG. 4) as well as diagonal beams 76 and 78 which are attached to a drum collar support 80 disposed centrally in the rig. Additional lateral bracing is provided by side struts 82 and 84 connected between opposite frame members 56L and R and the collar support 80. The collar support 80 defines the position of metered materials discharge, and the frame 52 is adapted to receive the cement mixer in the rearward position, as will be further described.

A large volume cement mixer drum 86 is movably positioned on a carriage frame 88 which is positioned for controlled movement along the length of the elongated frame 52. The carriage frame 88 is of generally square configuration consisting of a forward bar 90 and a rearward, parallel bar 92 interconnected by opposite side bars 94L and R. The carriage frame 88 is supported by a quadrature array of grooved wheels 96L and R and 98L and R, which are each grooved to ride on respective guide rails 60L and R. The mixer drum 86 in the usual cement mixer configuration includes a first cone end 100 having an axial opening (discharge opening) 102 and a rearward cone end 104 having axial inlet opening 106.

The mixer drum 86 is normally carried with the forward end 102 downward within opposite side frame members 56L and R (see FIG. 3), and mixer drum 86 is secured in this position by means of a circular yoke ring or flange 108 disposed around mixed drum 86 and rigidly secured, as by welding, to opposite side support plates 110 and 112. The reinforced opposite side plates 110 and 112 are then secured as by welding to the opposite side lever plates 114 and 116 which are pivotally secured at pivot posts 118 and 120 to the opposite side bars 94L and R of carriage frame 88. The flange 108 is secured rigidly as by bolting to the inner bearing race of a ball bearing 121 that completely surrounds mixer drum 86, as will be further described. Thus, as will be further discussed below, the lever plates 114 and 116, having respective lever arms 115 and 117 as pivotally attached to rod ends 123 and 125 of extensible hydraulic cylinders 122 and 124, can be rotated forward to a dump position. Each of the hydraulic cylinders 122 and 124 is pivotally secured to respective side bars 94L and R by means of pivot connections 126 and 128.

The carriage frame 88 supported on grooved trolley wheels 96L and R and 98L and R is positioned movably on guide rails 60L and R which extend in parallel as secured along the length of the upper part of frame 52. The carriage frame 88 is movable from its normal, rearward position on guide rails 60L and R by means of opposite side elongated hydraulic cylinders 130 (see FIG. 3) retracting actuator rods 132 thereby to draw cables 134L and R around respective pulleys 136L and R to pull the mixer frame 88 forward to the dump position. The pulleys 136L and R are suitably journaled proximate the forward ends of upper frame plates 64 and the respective opposite side hydraulic cylinders 130 are actuated through a single, elongate stroke to draw the mixer frame forward.

Figure 5:
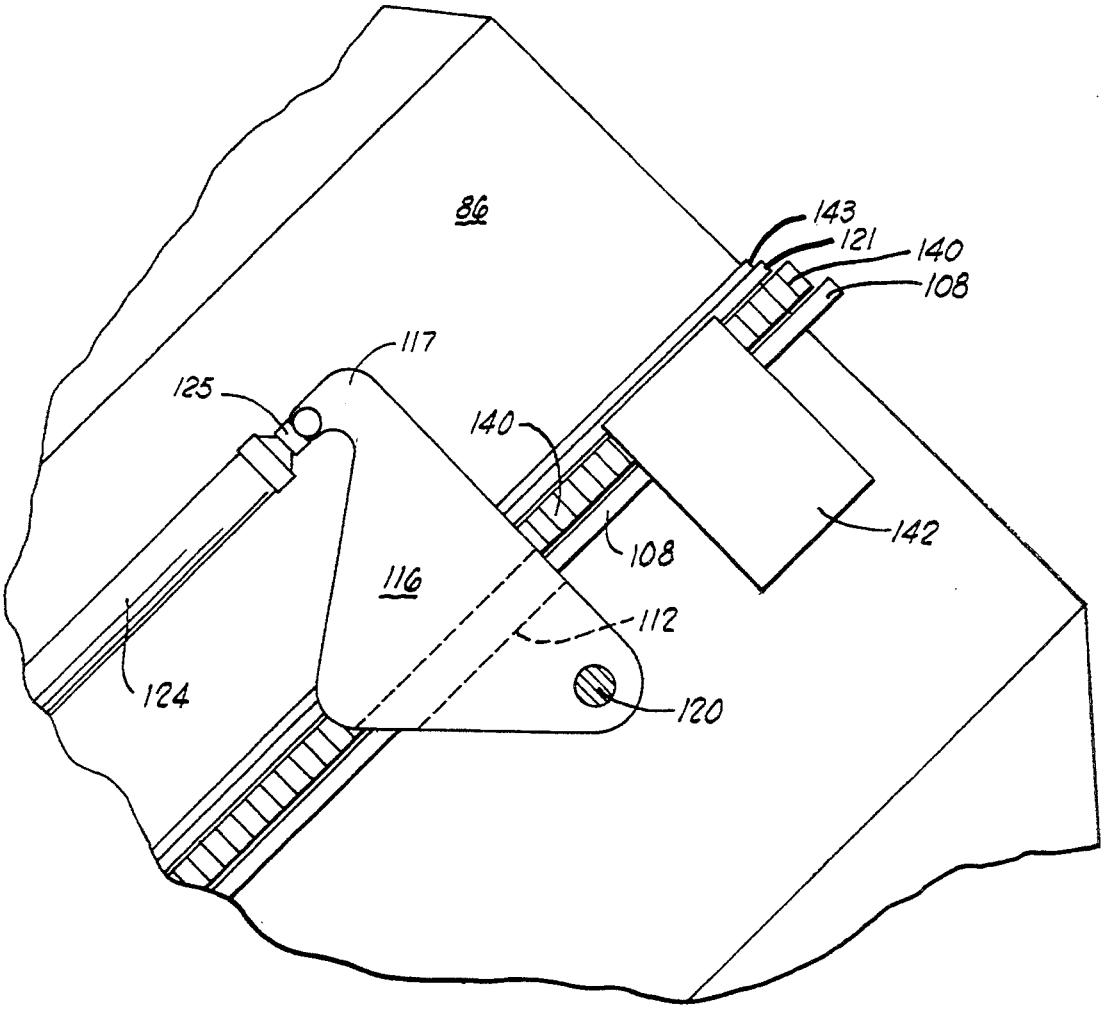
FIG. 5 is an enlargement of the FIG. 3 view of a portion of the cement mixer and securing yoke.
Figure 5:
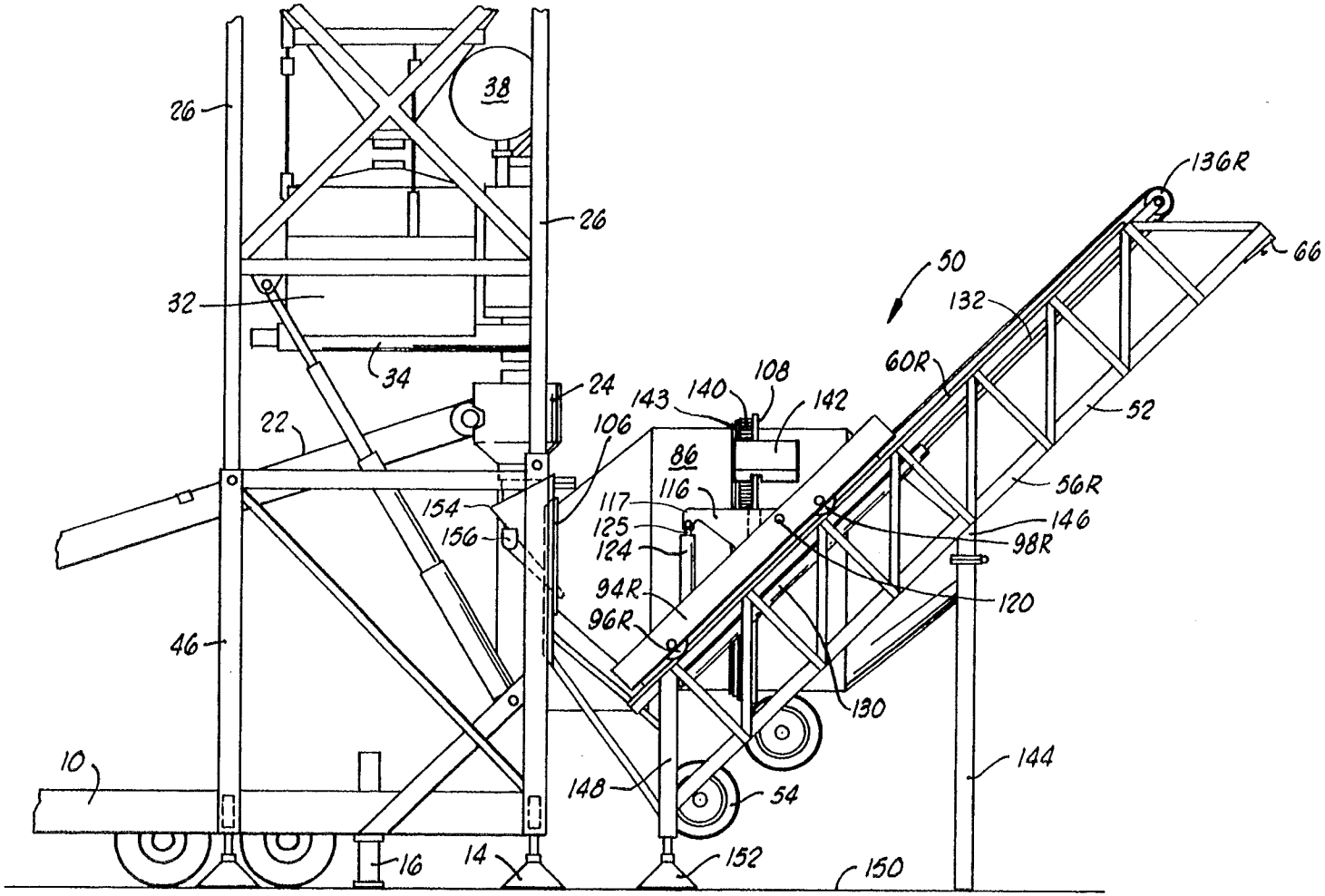

As shown also in FIG. 5, the mixer drum 86 is securely supported within the circular yoke flange 108 which is further rigidly affixed by means of the opposite side, reinforced support plates 110 and 112 welded to respective lever plates 114 and 116. The circular flange 108 provides a support for the mixer drum 86 through bearing 121 which allows it to rotate during cement mixing operation. A ring gear assembly 140 is secured in superposition over the outer race (not shown) of bearing 121 while the inner race of bearing 121 is rigidly secured to a second flange 143 disposed around the mixer drum 86. A suitable form of hydraulic motor assembly 142 mounted to ring yoke 108 provides rotational drive to ring gear 140 and mixer drum 86. Such hydraulic drive motors 142 and associated drive gearing are well-known in the art and may be selected as a matter of choice depending upon the exigencies of the application.

Referring again to FIG. 3, the underside of frame 52 includes right and left side foldable stanchions which are used for the purpose of supporting the cement mixer rig when it is raised to the operative condition in combination with a concrete batching plant. The raising is carried out or aided by auxiliary structure (not shown), for example a heavy duty crane. Thus, each side of the cement mixer 50 includes foldable stanchions 144 which extend from a hinge post 146 that is secured, as by welding, to proximate the middle of the lower frame member 56L and R, respectively.

As shown in FIG. 6, the mixer assembly 50 is raised up and installed in operative position with frame 52 disposed at an angle of about 45° relative to the supporting surface 150. The stanchions 144 can then be folded down and locked into the vertical position to provide support from surface 150 and a rear support leg 148 is positioned in ground contact by means of adjustable jack stabilizers 152. The stanchions 144 are approximately twice the length of the rear support leg 148. The portable cement mixer 50 is thus positioned in relation to the batching plant tower 26 so that the mixer input opening 106 is in position to receive batching plant discharge via funnel collector 24 (FIG. 1). A solids director 154 and a liquids conduit 156 may be used to aid in conducting the aggregate and water into the mixer 86 in well-known manner. Thus, and referring to FIG. 2, the solids mixture through collector funnel 24 would be directed into collector 154, and the liquid downflow from water conduit 42 would be directed into conduit 156.

When all weighed input materials and the requisite amount of water have been placed in the cement mixer drum 86, mixing may commence by energization of the hydraulic motor 142 through the associated driving ring gear 140 as the mixer drum 86 is rotated to provide the mixing motion. A suitable hydraulic reservoir and supply system of requisite size (not shown) is normally supplied with the batching plant of FIGS. 1 and 2; however, a suitable auxiliary hydraulic pressure source may be supplied with the cement mixer assembly 50 in order to energize the hydraulic motor 142 as well as the dump cylinders 122 and 124 and the trolley cart elongated cylinders 130.

Figure 7:
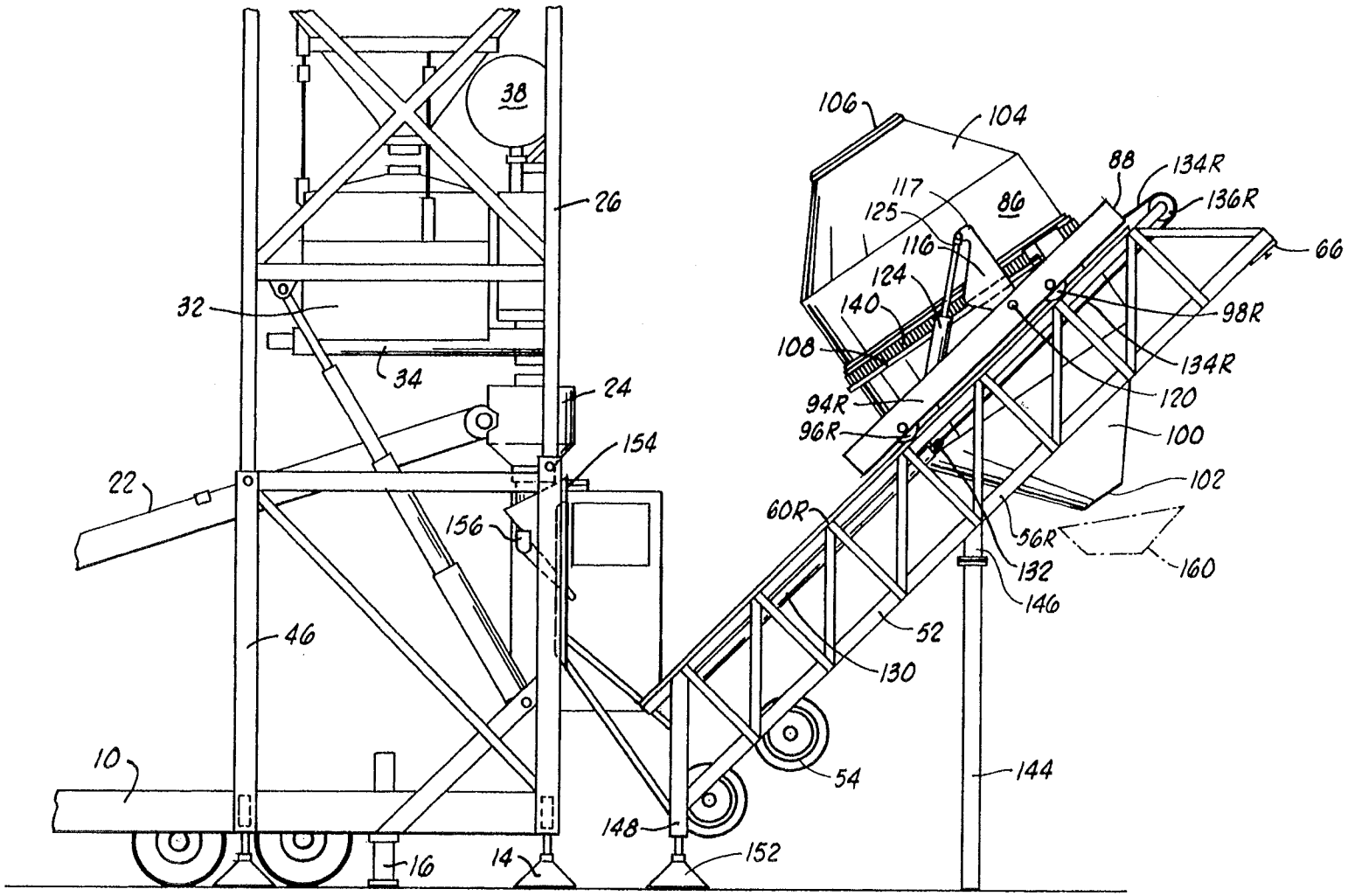
FIG. 7 is a view in side elevation similar to that of FIG. 6 except that the concrete mixer has been hydraulically actuated to the dump attitude.

After all input material to the mixer drum 86 has been mixed completely, the cement mixer 50 is ready for dumping of the mixed concrete which may include a plurality of individual truck loads. As shown in FIG. 7, the dump function has been energized wherein the elongate cylinders 130 have been energized to retract respective rods 132 thereby to draw tow cable 134L and R around respective pulleys 136L and R such that mixer carriage 88 has been moved to the topmost position along guide rails 60L and R. At this position, the dump cylinder actuation may be effected by actuating cylinders 122 and 124 to extend their respective rods thereby to rotate lever plate 114 and 116 through about a 55° clockwise rotation to dump mixer drum 86 so that the outlet opening 102 directs the mixed material into a receiving receptacle. In FIG. 7, the phantom outline 160 represents an imaginary area wherein vehicle loading may take place. Thus, a plurality of open bed vehicles may pull successively beneath the outlet 102 where each receives a predetermined amount of mixed material such as concrete.

The foregoing discloses a novel cement mixer design, one occasioned by portability as the cement mixer is employed in a unique combination with mobile concrete batch plants of various design configurations. The present cement mixer is not only attractive from the portability and adaptability standpoints but also from the fact that it offers a high volume concrete mixing apparatus that will enable large batches of concrete to be prepared for rapid shuttling via open trucks and conveyors to the construction site.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A portable cement mixer installation, comprising:

a frame supported at a first end by a wheel assembly and having a hauling connection at the second end, the frame being adapted to be upended on the first end during operation;

first and second rails disposed over opposite sides of the frame in parallel alignment, each rail being rigidly supported by said frame;

a support carriage including opposite side wheels movably supported on said first and second rails, and normally disposed proximate the frame first end;

a yoke ring pivotally supported on said support carriage;

a cement mixer drum positioned in said yoke ring on said support carriage and controllable to rotate around a longitudinal axis of the drum;

a hydraulic motor assembly secured on said yoke ring and connected to rotate said cement mixer drum;

first hydraulic means connected by a cable to said support carriage and actuatable to pull the support carriage up along the first and second rails to a dump position; and second hydraulic means actuatable to rotate the cement mixer drum downward to dump the mixed content.

2. Apparatus as set forth in claim 1 which is further characterized to include:

a first pair of stanchion posts each secured on opposite sides to the frame first end and extending at a forward angle of about 45° to a respective one of said first and second rails; and a second pair of stanchion posts which are approximately twice the length of said first pair, hingedly secured to opposite sides of the frame proximate the middle thereof;

whereby said frame second end can be raised to installation attitude of about 45° and supported on said first and second pairs of stanchion posts.

3. Apparatus as set forth in claim 1 wherein said first hydraulic means comprises:

a pulley secured proximate the frame second end; and a hydraulic linear actuator with reciprocal rod end secured to the frame below said support carriage, said reciprocal rod end being normally extended with the reciprocal rod end connected to said cable that is led around said pulley for connection to the support carriage such that actuation of the hydraulic linear actuator retracts the reciprocal rod end to draw said support carriage and cement mixer drum forward along the first and second rails to a dump position.

4. Apparatus as set forth in claim 3 wherein said second hydraulic means comprises:

a lever plate secured to said yoke ring to support at least one side of said cement mixer drum;

a hydraulic linear actuator with rod end normally retracted connected between the support carriage and the lever plate such that actuating the rod end to an extension position rotates the cement mixer drum forward to a downward dumping attitude.

5. Apparatus as set forth in claim 1 wherein said second hydraulic means comprises:

a lever plate secured to said yoke ring to support at least one side of said cement mixer drum;

a hydraulic linear actuator with rod end normally retracted connected between the support carriage and the lever plate such that actuating the rod end to an extension position rotates the cement mixer drum forward to a downward dumping attitude.

6. Apparatus as set forth in claim 1 wherein said frame further comprises:

first and second elongate side frames aligned in parallel; and transverse members rigidly secured between said first and second side frames at the first and second ends.

7. Apparatus as set forth in claim 6 which is further characterized in that:

said first and second rails are rigidly secured on the respective first and second elongate side frames and extending the proximate length thereof.

8. Apparatus as set forth in claim 1 wherein said support carriage further comprises:

a generally square, four cornered frame structure including side bars and front and rear transverse bars secured therebetween; and four corner reinforcing means connected between said side bars and said front and rear transverse bars.

9. Apparatus as set forth in claim 1 which is further characterized to include:

first and second lever plates pivotally secured to said support carriage on each side of said yoke ring with said first and second lever plates being rigidly secured to said yoke ring; and means pivotally connecting the respective lever plates to said second hydraulic means.

10. Apparatus as set forth in claim 9 wherein said second hydraulic means comprises:

first and second linear actuators connected between the support carriage and said respective first and second lever plates and actuatable to an extension position to rotate said cement mixer drum downward.

11. Apparatus as set forth in claim 1 which is further characterized to include:

a ring gear secured around said cement mixer drum at a point adjacent the yoke ring; and mounting means secured to said yoke ring independent of said cement mixer drum to support said hydraulic motor assembly in driving engagement with said ring gear.

12. A portable cement mixer apparatus for use in combination with a mobile batch plant that provides weight proportioning and delivery of selected aggregate, cement and water as directed to a mixer charging position, comprising:

a wheeled frame having first and second ends and including first and second track rails supported thereon in relative parallel relationship;

at least one foldable stanchion connected to support said frame at an angle of about 45°;

a support frame with first and second side wheels riding on said first and second track rails;

a cement mixer drum rotatably mounted with two degrees of freedom in said support frame and normally positioned to receive materials input at said mixer charging position;

a hydraulic motor assembly secured to the cement mixer drum and connected to revolve said cement mixer drum about its longitudinal axis;

first hydraulic means actuatable to pull the support frame up along the first and second track rails to a dump position; and second hydraulic means actuatable to rotate the cement mixer drum about a transverse axis to dump the mixed content at the dump position.

13. A combination as set forth in claim 12 which is further characterized to include:

a first pair of stanchion posts each secured on opposite sides to the wheeled frame first end and extending at a forward angle of about 45° to a respective one of said first and second track rails; and a second pair of stanchion posts which are approximately twice the length of said first pair, hingedly secured to opposite sides of the wheeled frame proximate the mid-point;

whereby said wheeled frame second end can be raised to installation attitude of about 45° and supported on said first and second pairs of stanchion posts.

14. A combination as set forth in claim 12 wherein said first hydraulic means comprises:

first and second pulleys mounted on the first and second track rails above the wheeled frame second end; and first and second hydraulic linear actuators having first and second rod ends, said linear actuators each being secured to the wheeled frame below said support frame and normally having first and second rod ends in an extension position, with the respective rod ends connected via a cable led around said respective pulleys to the support frame such that actuation of the first and second hydraulic linear actuators retracts the first and second rod ends to draw said support frame and cement mixer drum forward along the first and second track rails to a dump position.

15. A combination as set forth in claim 14 wherein said second hydraulic means comprises:

first and second lever plates secured to opposite sides of said rotary cement mixer drum and extending first and second lever arms generally parallel to the mixer drum longitudinal axis;

first and second hydraulic linear actuators with first and second rod ends retracted, said respective linear actuators being connected between the support port frame and the respective lever arms such that actuating the respective rod ends to an extension position rotates the cement mixer drum to a downward dumping attitude.

16. A combination as set forth in claim 12 wherein said second hydraulic means comprises:

first and second lever plates secured to opposite sides of said rotary cement mixer drum and extending first and second lever arms generally parallel to the mixer drum longitudinal axis;

first and second hydraulic linear actuators with first and second rod ends retracted, said respective linear actuators being connected between the support frame and the respective lever arms such that actuating the respective rod ends to an extension position rotates the cement mixer drum to a downward dumping attitude.

* * * * *